United States Patent [19]

Shaw

[11] Patent Number: 4,667,646

[45] Date of Patent: May 26, 1987

[54] EXPANSION COMPRESSION SYSTEM FOR EFFICIENT POWER OUTPUT REGULATION OF INTERNAL COMBUSTION ENGINES

[76] Inventor: David N. Shaw, 33 Silversmith Rd., Unionville, Conn. 06085

[21] Appl. No.: 815,497

[22] Filed: Jan. 2, 1986

[51] Int. Cl.[4] ..... F02B 33/00

[52] U.S. Cl. ..... 123/559; 418/201

[58] Field of Search ..... 60/397; 123/559, 564; 418/201

[56] References Cited

U.S. PATENT DOCUMENTS 2,266,820 12/1941 Smith ..... 123/559 X
3,088,658 5/1963 Wagenius ..... 418/201
4,508,089 4/1985 Baumgartner et al. ..... 123/559

FOREIGN PATENT DOCUMENTS 119018 7/1984 Japan ..... 60/397
45719 3/1985 Japan ..... 123/559

*Primary Examiner*—Stephen F. Husar
*Attorney, Agent, or Firm*—Sughrue, Mion, Zinn, Macpeak, and Seas

[57] ABSTRACT

A system for efficient power output regulation of internal combustion engines employs an engine intake air expansion/compression device coupled to the engine and driven thereby. The device has a variable volume chamber and a control for admitting and abruptly trapping desired volumes of atmospheric air within the chamber. The trapped volume of air is expanded to maximum value and then reduced after expansion until the engine intake displacement volume level is reached. At that point, the device exposes the trapped volume of air to the engine intake manifold. As the device is coupled to the engine, its maximum chamber volume per engine revolution remains essentially a fixed ratio of engine intake displacement per engine revolution.

5 Claims, 8 Drawing Figures

FIG. 1
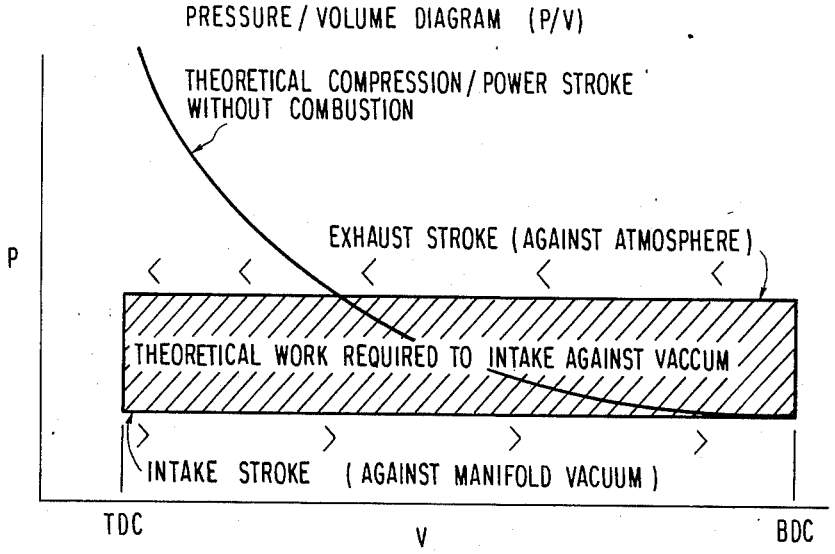
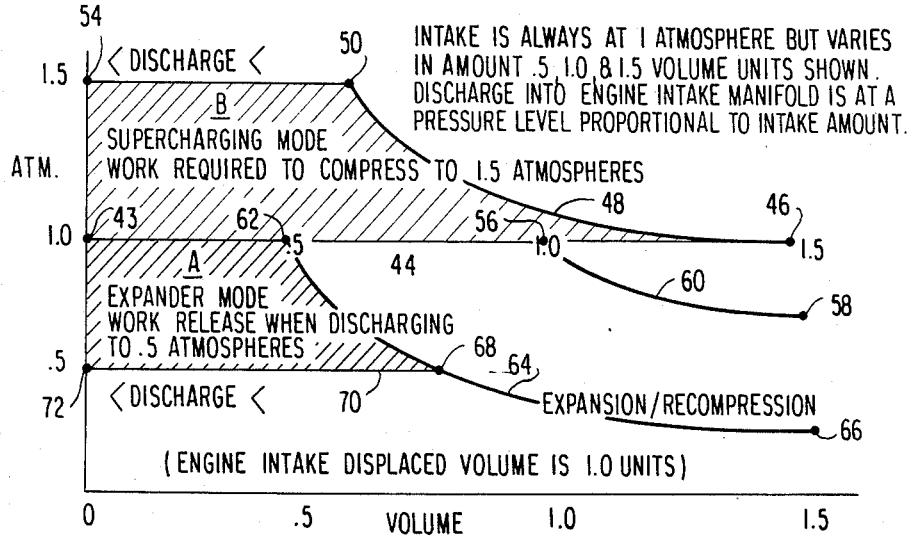
FIG. 2

EXPANSION COMPRESSION SYSTEM FOR EFFICIENT POWER OUTPUT REGULATION OF INTERNAL COMBUSTION ENGINES

FIELD OF THE INVENTION

This invention relates to supercharging systems for internal combustion engines and, more particularly, to an improved helical screw rotary positive displacement machine which serves to completely control the intake air flow to the engine during all operating conditions and, thus, eliminates the conventional throttle valve currently necessary. The invention utilizes unique rotor profiles such as are typically described in copending U.S. patent application Ser. No. 808,988 filed Dec. 16, 1985, by Robert A. Ingalls entitled "SCREW ROTOR MACHINE WITH SPECIFIC LOBE PROFILES". This invention serves to efficiently compress air during engine "boost" or supercharging modes and also serves to efficiently expand air during periods of engine operation when lower power output is required. This expansion mode recovers a portion of the energy that is normally lost when a typical engine is operating at throttle positions which result in intake manifold pressures less than atmospheric.

BACKGROUND OF THE INVENTION

Power output regulation of internal combustion engines is necessary. This is typically accomplished by using a throttle valve to restrict the amount of air admitted to the engine when less than full power output is required. In addition, turbochargers and superchargers are used to increase engine air charge well above that inducted with normal atmospheric pressure and wide open throttle.

At throttle valve positions less than wide open, increasingly significant air flow work must be done by the engine itself in order to induct less and less air. This is because the typical engine inducts a fixed volume of air per revolution and thus can only induct a lower weight of air by drawing from a source that has been reduced in pressure by some means. This flow work can be understood by realizing that whenever the engine is drawing upon a low pressure source of air, it must still exhaust to atmospheric pressure. The net flow work required is thus equal to this net pressure differential times the engine intake displacement.

Screw type machines are currently in use for the supercharging of internal combustion engines. However, they function only in the compression mode and do not, by themselves, serve to control the air flow to the engine. Other control means such as throttle valves and bypass valves are used for the airflow control to the engine. These current superchargers have no need for a unique rotor profile such as is described in the already mentioned copending application.

The concept of screw type machines alternately working as a compressor or an expander already exists in the prior art. Such a device is conceptually shown in U.S. Pat. No. 4,220,197 of which the current applicant is a patentee. However, that screw device in the form of a helical screw rotary compressor/expander was conceived to act as an air conditioning compressor whenever that function was required in its vehicular application. When air conditioning was not required, the device would then act to recover energy from refrigerant which was first vaporized at high pressure by heat exchange with the vehicle exhaust gas. Two slide valves are incorporated in the compressor/expander for control purposes. High pressure refrigerant is admitted to the device when expansion (for energy recovery) is taking place and low pressure refrigerant is admitted when compression (for air conditioning) is taking place. This particular device was never reduced to practice, yet stands as prior art to the instant invention.

After study, it became apparent to the present inventor that the throttle valve in an automotive engine causes a significant waste of developed power whenever the engine is operating at reduced power outputs for a given speed. This loss comes about because the engine is caused to intake under a vacuum condition yet must finally exhaust to atmospheric pressure.

It is a primary object of the present invention to provide an internal combustion engine system which allows the necessary variation in automotive engine power output for a given speed but which also works to eliminate the engine intake throttle loss.

It is a further object of the present invention to provide an internal combustion engine system utilizing a positive displacement compressor/expander feeding combustion air to the engine intake manifold in which the compressor/expander functions preferably for supercharging the air, in which complete engine air flow control is accomplished with a single valve eliminating the conventional engine throttle valve resulting in immediate throttle response at slow engine speed with increased supercharger compression efficiency and with increased vehicle mileage by utilizing energy recovery during engine intake manifold vacuum conditions.

SUMMARY OF THE INVENTION

The present invention fills the need for a device that will regulate the amount of air admitted to the engine while eliminating the power loss associated with the use of a conventional intake throttling valve. The generic nature of this device follows.

The amount of air admitted to the device is determined by the final power output requirement desired by the operator of the engine. The air, once admitted, is first expanded, then compressed, then discharged to the engine intake manifold. The system processes are thus: Admission; Expansion; Compression; Discharge.

The admission process allows variation from a predetermined minimum to maximum volume of inducted air depending on the final output power desire of the engine operator. The actual process starts at the 0 volume point and concludes at the point where sufficient operator desired air is inducted.

The expansion process begins upon the admission termination point and continues until the point where maximum device volume is reached.

The compression process then takes place from this maximum volume point to the point where engine intake volume is reached.

The discharge process then starts at this point and continues until the 0 volume point is again reached, whereupon all air initially admitted has now been delivered to the engine intake manifold and the cycle then starts anew.

Generally, on admission, the instant invention allows the atmosphere to do flow work against a moving wall(s) of an increasing volume until the operator desired amount of air has been admitted to this increasing volume. When this occurs, induction is abruptly terminated and the now trapped air increases in volume until device maximum is reached. This expansion exerts further net work against the moving wall(s) until device maximum volume has been reached. After this point, wall(s) movement continues and the device trapped volume is now reduced until it reaches the point where the actual engine intake volume requirement is reached. At this point, the trapped volume is now exposed to the engine intake manifold and the device volume is reduced to zero as wall(s) movement continues and air is expelled into the engine intake manifold. Work is done by the device moving wall(s) as the volume is reduced to zero. After this point, the cycle starts anew. With final net air expansion, work is taken from the device. With final net air compression, work is delivered to the device.

As the device trapped volume equals the engine intake volume at the point of exposure to the engine intake manifold, a device intake volume of less than engine intake volume thus results in net expansion/pressure reduction; a device intake volume equal to engine intake volume results in no net volume or pressure change and a device intake volume greater than engine intake volume thus results in net compression/pressure increase.

Therefore, since the device has a means of varying its intake volume between a predetermined minimum and maximum amount, it is obvious that the total engine power output control function is now be accomplished by this simple expansion compression system. This system replaces all functions previously accomplished by intake throttle valves in combination with turbochargers or superchargers along with their associated wastegate, bypass valves, etc.

The present invention is further directed, in part, to the incorporation of a novel and effective compressor-/expander, preferably operating as a supercharger in an internal combustion engine driven vehicle. The vehicle drive system includes an engine drive train. The engine has at least one cylinder housing a reciprocating piston defining the engine volumetric displacement, an air intake manifold opening to said cylinder, an exhaust manifold leading from said cylinder, a compressor/expander having a variable air inlet port open to the atmosphere and a fixed air outlet port. The compressor/expander air outlet port is connected to the engine intake manifold. The improvement resides in the compressor-/expander being a positive displacement machine and wherein the compressor/expander is directly connected to the engine drive train such that the engine drives the compressor/expander when operating under compression mode, and the compressor/expander helps drive the engine when operating under expander mode. The volume ratio of the compressor/expander is substantially equal to the displacement of the compressor/expander divided by the displacement of the engine, and wherein control means are operatively mounted to the compressor/expander at the compressor/expander air inlet port for progressively cutting off the inlet port and varying the volume of air introduced into the compressor/expander to directly vary the output power of the engine; whereby, when the compressor/expander operates in a supercharging mode, the control means is at a position whereby the compressor/expander increases the air pressure available at the outlet port to always expose the compressed air via the fixed outlet port to the engine intake manifold when the compressed air has reached the pressure level equal to that at which the engine intake is operating, and when operating in an expander mode, the control means operates to always expose the expander recompressed air via the fixed outlet port to the engine intake manifold when the expander recompressed air has reached the pressure level equal to that at which the engine intake is operating.

This invention, particularly in the form of a helical screw rotary machine, requires a low blowhole on both the compression and intake sides of the supercharger-/expander whereas conventional superchargers have a low blowhole only on the compression side.

BRIEF DESCRIPTION OF THE DRAWINGS

FIG. 1 is a pressure/volume diagram of internal combustion engine operation illustrating engine output loss due to intake against vacuum with a partially closed throttle for a conventional internal combustion engine.

FIG. 2 is a pressure/volume diagram illustrating the theoretical operation of the supercharger/expander of the present invention from a pressure/volume viewpoint.

DESCRIPTION OF THE PREFERRED EMBODIMENT

The invention is directed to the goal of efficient power output regulation of an internal combustion engine. Typical engines now operate with intake manifold pressures ranging from 5 PSIA up to as high as 25 PSIA or greater when turbocharging or supercharging is employed. The most common type of internal combustion engine uses spark ignition and also uses a throttle valve to control the amount of air admitted to the engine. The throttle valve is progressively closed to reduce the power output. The power output is reduced effectively as the throttle valve is closed, yet it is done at the expense of causing an increasing amount of the reduced power output to be expended in pulling an increasing vacuum across the throttle valve.

Figure 7:
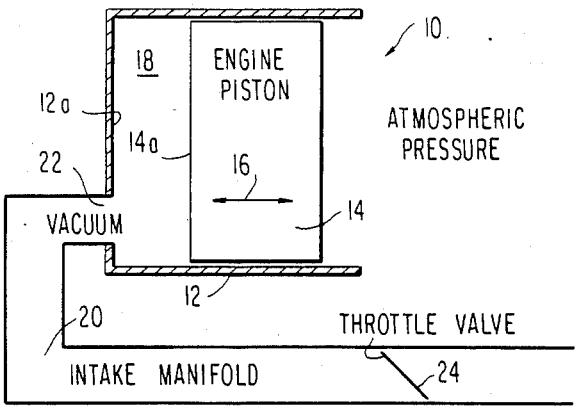
FIG. 7 is a schematic diagram of a conventional internal combustion engine with a throttle valve.
Figure 8:
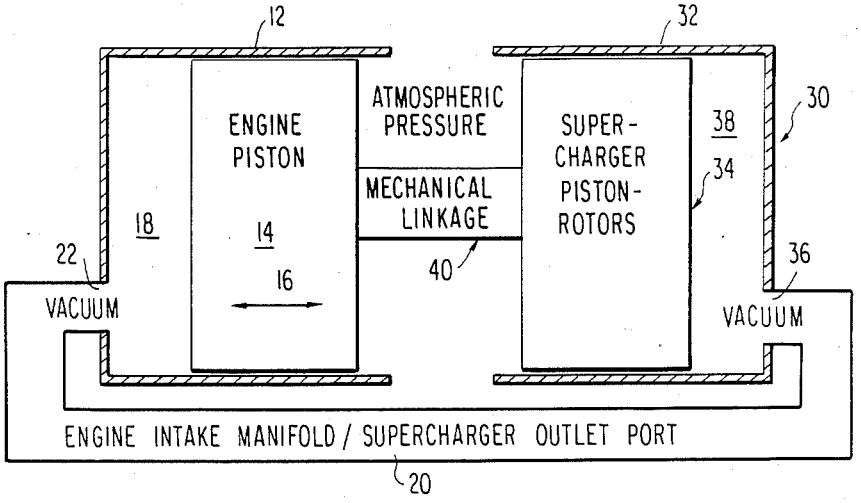
FIG. 8 is a schematic diagram of such engine employing the energy recovery control system of the present invention.

FIGS. 7 and 8 illustrate, in inverse order, how the energy recovery system effected by the compressor/expander of the present invention works relative to the conventional internal combustion engine throttle valve system.

In FIG. 7, a conventional spark ignition internal combustion engine is indicated schematically at 10, which may be of the four cycle type, comprising a cylinder 12 and a reciprocating piston 14. The piston 14 reciprocates, as shown by arrow 16, so as to alternately enlarge or reduce the volume, displaced by the piston of the engine working chamber 18 between the head 14*a* of the piston and the end wall 12*a* of the cylinder 12. The engine intake manifold 20 opens via intake port 22 to the working chamber 18 with the supply of air entering the chamber 18 controlled by a conventional butterfly throttle valve 24. Typically, the crank case of the internal combustion chamber 10 is at atmospheric pressure, as shown, to the opposite side of piston 14, and the engine piston 14, in moving away from cylinder wall 12*a* pulls the air into combustion chamber 18 under vacuum conditions against the atmospheric pressure acting on the opposite side of the piston. This requires work to accomplish that end during the intake stroke. As mentioned previously, the engine power output is reduced effectively as the throttle valve 24 is closed.

An important aspect of the present invention lies in the utilization of a compressor/expander in the form of a positive displacement machine and acting in a supercharging mode. This results in energy recovery and under conditions due to direct or indirect mechanical linkage between the engine and the compressor/expander wherein the energy recovery of the compressor-/expander (operating under expander mode) drives the engine and tends to balance the energy required by the engine piston to pull vacuum during the intake stroke.

In the schematic representation of FIG. 8, the internal combustion engine 10 is identical to that at FIG. 7. Engine piston 14 reciprocates within cylinder 12, and the working chamber 18 is connected to the engine intake manifold 20 via intake port 22. In the schematic representation of FIG. 8, a compressor/expander indicated generally at 30 preferably constitutes a helical screw rotary compressor/expander, such as that shown in cited U.S. Pat. No. 4,220,197. It is comprised of a compressor housing 32 housing a pair of intermeshed helical screw rotors, indicated schematically at 34, 36 forming compressor/expander working chamber or chambers 38, connected via a fixed outlet port 36 to the engine intake manifold 20. Preferably, the compressor-/expander 30 is a supercharger in that it has a maximum compression ratio in excess of one and therefore may take air at atmospheric pressure and discharges the same at a pressure in excess thereof.

As will be seen hereinafter, this may not necessarily be the case, while still utilizing the concept of the present invention, as energy recovery may be effected even though there is no increase in pressure between the air taken into the device 30 and that discharged therefrom directly into the internal combustion engine working chamber via the engine intake manifold 20. Further, and important to the present invention, is the utilization of some form of preferably direct mechanical linkage, indicated schematically at 40, between the intermeshed helical screw rotors 34 of the compressor/expander and the engine drive train of the internal combustion engine 10. As may be appreciated, some mechanism must be employed for converting the work represented by the reduction in pressure of the charge within the compressor/expander 30, when operating under expander mode, to mechanical energy inputted to the internal combustion engine 10 and absorbed in the engine piston 10 pulling the vacuum on the intake stroke within chamber 18 of the internal combustion engine 10.

Referring to U.S. Pat. No. 4,220,197 of which applicant is a copatentee, this patent shows in FIGS. 2 and 3, a positive displacement, compressor/expander utilizing intermeshed helical screw rotors 74, 76 within a compressor housing or casing 18, the rotors being mounted for rotation about their axes with the flanks thereof intermeshed. Appropriately, a capacity slide valve 46 controls the volume of fluid, or amount of charge entering the compression chamber defined by the intermeshed helical screw rotors, through a fixed inlet port 50*a*. A volume ratio slide valve 48 controls the point of discharge of the compressed or expanded working fluid discharged through fixed outlet port 52*a*. Such compressors/expanders and their principles of operation are well established in the art as represented by U.S. Pat. No. 4,220,197, and the content thereof is incorporated specifically by reference herein.

Referring next to FIG. 1, this figure demonstrates the work loss associated with pulling the vacuum by the internal combustion engine when the piston descends during the intake stroke. In contrast, the PV diagram of FIG. 2 for the compressor/expander 30, as described hereinafter with respect to FIG. 6, air at atmospheric pressure is fed through the expander compressor/expander inlet port for compression (or expansion) at a pressure which is always at one atmosphere. In all cases, the air intake action occurs along the 1.0 atmospheric pressure line 44. The control means in the form of a slide valve for the helical screw rotor type compressor-/expander, is at full open position and compression starts along line 44 at point 46 (designated 1.5). Compression continues from point 46 to point 50, on line 48. Discharge from the compressor/expander fixed outlet port takes place along line 52 between points 50 and 54 with the engine intake manifold 20 receiving compressed air in the amount of 1.5 volume units, thus the compressor/expander is operating under a supercharging mode. Theoretically, the work required to compress to 1.5 atmospheres is indicated at area B between lines 44 and 52 through points 43, 46, 50 and 54. Intake via the variable inlet port to the compressor/expander 30, FIG. 8, is always at one atmosphere but varies in amount of 0.5, 1.0 and 1.5 units shown, depending upon the position of the slide valve control means controlling the cutoff of the compressor/expander 10 variable inlet port. Appropriately, the compressor/expander intake could be reduced to an amount of 0.1 volume unit, if desired.

Note the contrast in FIG. 2, when the compressor-/expander is operating under conditions where the discharge from the compressor/expander is at 1.0 volume unit that is equal to that of the intake. Under these conditions, air intake starts on line 44 at point 43, air expansion occurs along line 60 from point 56 to 58 and then air recompression occurs back along the same line from point 58 to point 56 with air discharge being of a volume unit 1.0 equal to that of intake.

FIG. 2 also illustrates the operation of the compressor/expander 30 in the expander mode in which there is energy recovery and beneficial work release when discharging the intake volume unit at a pressure less than atmospheric pressure. As illustrated, discharge is one-half of the pressure at intake, that is, at 0.5 atmospheres. In this case, intake occurs at atmospheric pressure as indicated, along line 44 terminating at point 62. and the atmosphere air expands in pressure along line 64 to point 66 with recompression back along line 64 but only up and to point 68. Discharge occurs at pressure level of 0.5 atmospheres along line 70 from point 68 to point 72. The amount of energy recovery or work release is proportional to the area A between lines 44, 70, as defined by points 43, 62, 68 and 72. It should be appreciated that in the discussion of the theoretical operation of the compressor expander of the present invention, as exemplified by FIG. 2, the engine intake displacement volume is equal to 1.0 units while the compressor/expander displacement is 1.5 volume units, permitting supercharging operation.

As an example, an automobile travelling at 55 miles per hour on a level road may very well expend 15% of the engine's available power output to pull the vacuum necessarily associated with the reduced power output required to maintain the speed of 55 miles per hour. This 15% loss is a high price to pay for control alone.

The present invention deals effectively with this loss while at the same time allowing effective and efficient supercharging of the engine upon driver demand. A key aspect of the present invention is that, at engine power outputs less than that associated with full atmospheric pressure admitted to the engine, applicant's compressor-/expander will operate as an air expander, admitting to itself only that amount of air necessary to maintain the desired amount of power, then expanding that air automatically down to the pressure level associated with that amount of air induction into the engine intake manifold.

The compressor/expander of the present invention has a predetermined ratio of volumetric displacement relative to the engine intake volumetric displacement. For discussion purposes, the ratio of the new device displacement to engine intake displacement will be 1.50 to 1. However, that ratio may well range from 1.0 to 1, to 3 to 1. The device maintains this maximum displacement ratio regardless of speed, and thus may be linked directly to the engine drive line by means of gears, chains, belts, or whatever other type of drive arrangement as may be conceived.

The amount of atmospheric pressure air admitted to the device (per revolution of the engine) may be varied anywhere from a maximum of 1.50 times the engine intake displacement to a predetermined minimum which may range as low as 0.10 times the engine intake displacement volume.

When the device 30 shown is admitting maximum volume (1.5 times engine intake volume), it will thus be supercharging the engine by forcing 1.5 times as much air into the engine intake manifold as would be taken in with a wide open throttle without the new device.

This new device will then compress the inducted air until its volume now matches the intake volume of the engine. At this point, the compressed air is then exposed to a fixed exhaust port which communicates directly into the engine intake manifold. It should be now noted that the device may be viewed as a helical screw rotary type compressor/expander basically similar to that of U.S. Pat. No. 4,220,197, but the trapped interlobe volume remaining at the point of fixed outlet port exposure is now essentially equal to the intake volume displaced by the engine it is connected to. This is significant and it is a required feature in order to maintain efficient operation as a compressor or as an expander as will be addressed.

Next, assume the inlet to the helical screw rotary device 30 is adjusted to admit exactly 1.0 times the engine intake displacement volume. Once the air is admitted to the rotors at atmospheric pressure and then admission is cut off by rotor lobe rotation away from the port, the atmospheric air trapped in the interlobe volume cavities defined by the intermeshed helical screw rotors and compressor casing, when cutoff from the inlet and outlet ports, will be expanded to 1.5 times its original volume and then recompressed to 1.0 times its original volume, at which time the outlet port is then exposed to the trapped charge. This means the inducted air has been recompressed back to atmospheric pressure and the amount of air inducted in the first place was exactly equal to what the engine would have received with a wide open throttle valve admitting full atmospheric pressure to engine intake manifold. For discussion purposes, the device 30, intake, expansion, recompression, and discharge all take place with no theoretical loss. It is understood that losses will exist and they will be explained hereinafter. What is important is to appreciate the theoretical framework of the device 30 in such a way as to easily understand the various modes of operation which, in reality, will exist on a continuum basis as the vehicle accelerator pedal is pressed down or released upward.

Now, assume the inlet to the helical screw rotary device is adjusted to admit exactly 0.5 times the engine intake displacement. In this case, the admitted air will be expanded to the maximum 1.5 value and then recompressed to the 1.0 value whereupon the exhaust port is then exposed.

In a screw type device, such as a helical screw rotary compressor/expander, Vi, or volume ratio is a term frequently encountered. It is a term for expressing the ratio of the screw maximum rotor interlobe volume divided by the interlobe volume remaining after compression has taken place and immediately upon initial instant exposure of that remaining trapped volume to the exhaust or discharge port. In this invention, the unique situation exists whereby the desired Vi or volume ratio is equal to the displacement of the screw device divided by the displacement of the engine. This fixed Vi in combination with an inlet cutoff slide valve (which will be described hereinafter) allows the device to eliminate the throttle valve normally required of a spark ignition internal combustion engine.

This invention allows complete airflow regulation on a continuum basis without the basic loss associated with the current engine throttle valve. It also allows efficient compression when extra power output is required. Conceivably, it permits even more efficient operation of a typical four cylinder automobile engine while still giving that engine the peak power output of an equivalent normally aspirated six cylinder engine (of equal displacement per cylinder). This is quite significant. [FIG. 2 shows a PV diagram demonstrating the theoretical operation of the invention.] From the above, it must be appreciated that the invention involves the combination of a fixed Vi compressor/expander coupled directly to an internal combustion engine. The Vi of the compressor/expander is substantially equal to the ratio of compressor/expander displacement divided by that of the engine. The compressor/expander is also fitted with an adjustable inlet cutoff control slide valve which will allow an increasing interlobe volume of the intermeshed screw rotors of the supercharger/expander to be exposed to atmospheric pressure as the adjustable cutoff slide valve is progressively moved towards the solid line full open position, FIG. 3, from full closed position, as shown in dotted lines. At full open, the supercharging effect is equal to the displacement of the compressor/expander divided by that of the engine. In addition, a conventional throttle valve is no longer required nor are any other types of bypass/wastegate valves required such as are necessary with conventional types of superchargers and turbochargers. Reductions in engine power output are accomplished by progressively reducing the screw rotor interlobe volume that is exposed to inlet atmospheric pressure by shifting the slide valve or other control means at the compressor/expander inlet port. At reduced inlet volumes, the atmospheric pressure air admitted is then expanded and delivers its work of expansion directly to the flanks of the intermeshed helical screw rotors which are directly coupled to the engine drive train by some means. The expanded air is then delivered via the screw compressor/expander fixed outlet port to the engine intake manifold which is now at a pressure level that is determined by the volume of air that was admitted to the expander as compared to the volume of air inducted by the engine. If half the net engine volume is admitted to the expander, then the final engine intake manifold pressure will be approximately one half of an atmosphere as the admission of the expander was at full atmospheric pressure. The expansion energy released will tend to offset the energy required to pull the vacuum the engine intake manifold is operating under, thus, increasing engine efficiency.

Figure 3:
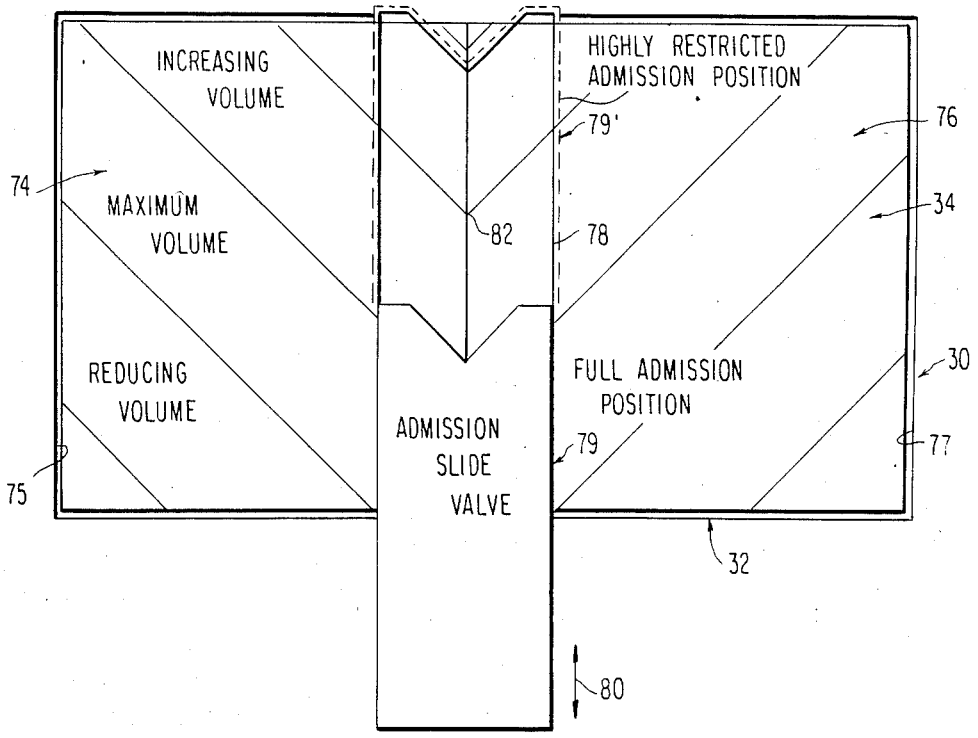
FIG. 3 is a schematic representation of an unwrapped view of the intake/expansion side of a helical screw rotary type supercharger/expander forming a preferred embodiment of the present invention.

FIG. 3 is a top plan representation of an unwrapped view of the intake/expansion side of a helical screw rotary type compressor/expander 30.

In order to appreciate the nature of intake and compression of the compressor/expander 30 under compression mode and intake and expansion without compression under expander mode, reference may be had to U.S. Pat. No. 3,885,402 to Harold W. Moody, Jr., et al, entitled "OPTIMIZED POINT OF INJECTION OF LIQUID REFRIGERANT IN A HELICAL SCREW ROTARY COMPRESSOR FOR REFRIGERATION USE", which utilizes schematic representations, particularly in FIGS. 1 and 3, of the compression and expansion process. The content of this patent is also incorporated by reference herein to facilitate an understanding and appreciation of the compressor/expander 30 of the present invention and its employment in combination with the internal combustion engine 10 for maximum effectiveness of the internal combustion engine, particularly for road vehicle application.

In FIG. 3, in like fashion to U.S. Pat. Nos. 3,885,402 and 4,220,197, a pair of intermeshed helical screw rotors 74, 76 are mounted for rotation about parallel axes within casing 32, and in particular within parallel, laterally intersecting bores 75, 77 within casing 32, within which the screw rotors 74, 76 are respectively mounted. An inlet port 78 is progressively closed off or opened by an admission slide valve or control means 79, which reciprocates in the direction of as shown by double headed arrow 80 so as to shift from the solid line full admission position to the dotted line highly restricted admission position 79', and vice versa. As the helical screw rotors 74, 76 are turned, the cusps 82 or intersection points of the rotor flanks move progressively down towards the bottom of the FIG. 3 diagram. As can be seen, the interlobe volume is constantly increasing to a maximum.

Figure 4:
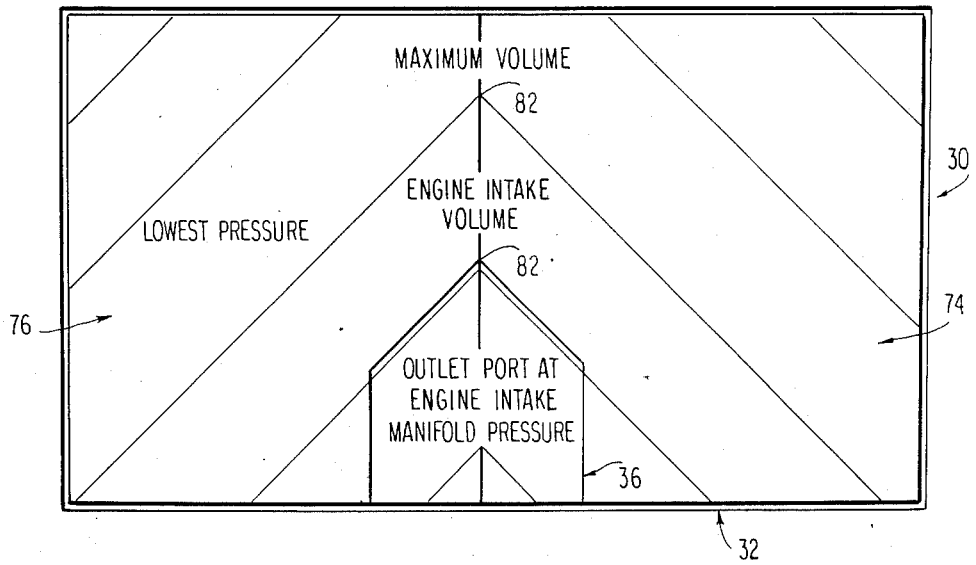
FIG. 4 is a schematic representation of an unwrapped view of the compression/discharge side of a helical screw rotary type supercharger/expander of FIG. 3.

FIG. 4 is a companion view of the unwrapped compression/discharge (the opposite side of the helical screw compressor/expander 30 to that of FIG. 3). Within casing 32, there is a fixed outlet port 36 which is connected directly to the engine intake manifold and is at engine intake manifold pressure. There is no control means or outlet slide valve in the conceptual embodiment shown. After the interlobe volume defined by the intermeshed helical screw rotors 74, 76 and casing 32, increases to a maximum, compression then takes place until. A reduced volume is discharged to the outlet port 36. In FIG. 4, the cusp points 82 move down as the rotors 74, 76 turn, and the discharge or outlet port 36 is exposed when the interlobe volume equals the engine intake volume at the fixed outlet port 36.

As may be appreciated from viewing FIG. 3, it can be seen that the admission slide valve 79, may only allow a small portion of the interlobe volume to be exposed. The atmospheric air will then be initially expanded to the maximum interlobe volume and then compressed to the attendant pressure reduction to meet the intake manifold pressure of the internal combustion engine 10. In FIG. 4, this low pressure air will be partially recompressed up until the interlobe volume is exposed to the outlet port 36. It will then be discharged into the engine intake manifold 20. If the admission slide valve 79 is fully open, then a full charge of atmospheric pressure air will be admitted, trapped without expansion, and then compressed as the interlobe volume now falls, as exemplified by the decreasing area of the V-shaped segments defined by the intermeshed helical screw rotors 74, 76, FIG. 4. Automatically, the outlet port 36 is exposed when the interlobe volume has been reduced to the volume of the engine intake. Efficient compression is achieved as the outlet port is in essentially the correct position for ideal compression just as it is in essentially the correct position for net expansion, due to the correlation between the predetermined ratio of volumetric displacement of the compressor/expander relative to the engine intake volumetric displacement.

Figure 5:
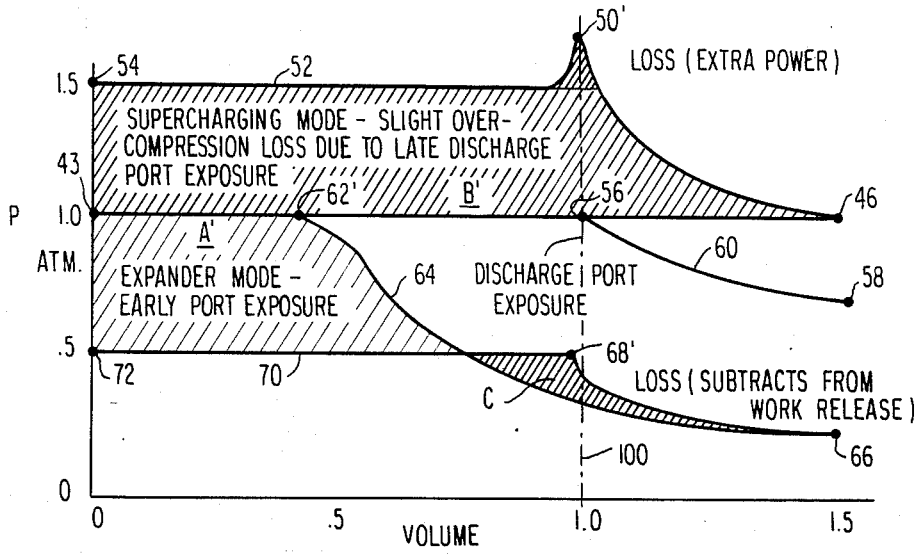
FIG. 5 is a pressure volume diagram of the supercharger/expander of FIGS. 3, 4 and 6 illustrating operation under both expander mode, with energy recovery and supercharging mode, with losses.

Turning next to FIG. 5, this shows a typical PV diagram for the compressor/expander, internal combustion engine unit of the present invention for the actual cycle as compared with the ideal theoretical cycle shown in FIG. 2. There are some minor differences, although the actual device operates very similar to that shown by the theoretical plot of FIG. 2. The differences may be explained briefly. In FIG. 5, the work area B' above line 44 and below line 52, utilizing numerals corresponding to the showing of FIG. 2, is enlarged slightly due to the fact that some additional compression occurs prior to discharge, so that compression along line 48 rises to a higher level as defined by point 50' under a supercharging mode. Discharge port 36 exposure occurs at vertical dotted line 100. Under expander mode operation, there is early port exposure which results in a loss, as defined by area C during expansion along line 64 from point 62' down to point 66 and then slight recompression back to a 0.5 atmospheric pressure, that is, up to line 70. In this case, discharge port exposure occurs at vertical dotted line 100. Thus, area C must be subtracted from area A' representing the work release or energy recovery of the unit under expander mode operation.

Figure 6:
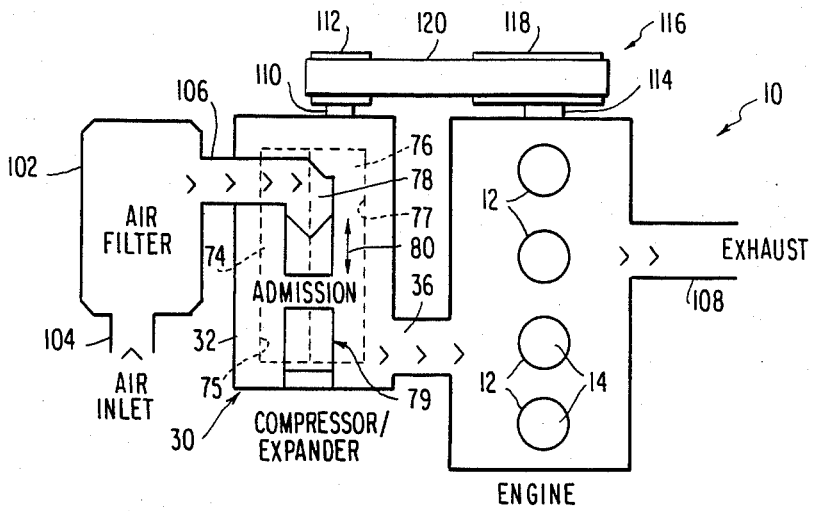
FIG. 6 is a schematic block diagram of a preferred embodiment of the supercharger/expander system employed with a typical multi-cylinder, spark ignition type internal combustion engine, forming a preferred embodiment of the invention and utilizing the supercharger/expander illustrated in FIGS. 3 and 4.

Turning next to FIG. 6, this figure shows a typical schematic block diagram hookup of the compressor/expander 30 to a four cylinder internal combustion engine 10 forming the expansion compression systems of the present invention. Engine 10 has four cylinder 12 within which are mounted reciprocating pistons 14 whose total piston displacement constitutes the given engine displacement of engine 10. Since the invention is couched in terms of engine intake displacment, if engine 30 were a two cycle engine, it would be the total piston displacement of all four cylinders; if a four cycle engine, only that of two of the cylinders. The helical screw rotors 74, 76 for the compressor/expander 30 are indicated in dotted lines with the admission slide valve or control means 79 superimposed thereon and selectively opening or closing off the fixed inlet port 78 of expander compressor 30. Conventionally, air filter 102 receives air through its air inlet 104 with a suitable tube or pipe 106 connecting the air filter to the compressor/expander 30 inlet port 78. The fixed outlet port indicated schematically at 36 connects by way of the intake manifold 20, to the engine 10, and the exhaust manifold for the engine is shown schematically at 108. Casing 32 for the helical screw compressor/expander 30 mounts the intermeshed helical screw rotors 74, 76 within appropriate lateral intersecting parallel bores 75, 77 for rotation about parallel horizontal axes. Helical screw rotor 76 is shaft connected, via shaft 110, to pulley 112. Further, the internal combustion engine 10 includes an output or drive shaft 114 which forms part of the engine drive train indicated generally at 116 with the shaft bearing a fixed pulley 118 on the outboard end of the shaft. Appropriately, an endless belt 120 couples the two pulleys 112, 118 so that there is a positive mechanical coupling between engine shaft 114 and shaft 110 fixed to and rotating with helical screw rotor 76 of the compressor-/expander 30. As may be appreciated, the drive train 116 may comprise appropriate sprocket wheels and an endless chain, or alternatively use a direct gear system or indeed an indirect drive system.

As may be appreciated, the screw compressor/expander unit or device 30 utilizes an admission slide valve 79 which is shiftable forward and back and which may be shifted as indicated by the double headed arrow 80 to function as a replacement for the typical engine throttle valve. It is expected that some form of motion amplification will be required for the admission slide valve 79 actuation. This may take the form of an enhanced servo system similar to that now used for throttle valve actuation in automobiles equipped with cruise control systems.

It is obvious that other types of positive displacement compressor/expander devices may also prove suitable for the stated purposes providing that the fundamental requirements set forth herein are reasonably met. As an example, a rotary multiple vane type compressor/expander with adjustable admission exposure to progressively increasing volume between successive vanes will conceptually perform the same function as described above. A swash plate type piston compressor/expander with an adjustable rotary admission valve will also conceptually perform the same function. With this type of device, the admission would be cut off at a different swash plate piston stroke position, depending upon the final engine power output required. As previously described, the discharge port of such swash plate type piston device would always be exposed when the remaining volume after compression essentially equals the engine intake displacement.

Conceptually, any positive displacement compressor-/expander may be used under conditions capable of practicing the basic method steps of this invention to allow initially atmospheric induction up to a certain point, cutoff of air induction and expansion until the full device trapped volume has been obtained, and then recompression until engine intake volume is reached, and finally exposure of the outlet port to the engine intake manifold under such matched conditions. All of the devices discussed herein has such theoretical capabilities.

There are multiple advantages of applicant's supercharging system and method of operation relative to conventional turbochargers and superchargers employed in supercharged internal combustion engine operation, particularly for road vehicles. No engine throttle valve is required. The complete engine air flow control is accomplished utilizing a single valve within the supercharging component of the internal combustion engine—compressor/expander combination. Immediate throttle response is achieved at slow engine speeds, even with vehicles equipped with automatic transmissions. Increased vehicle mileage ratings may be achieved due to energy recover during engine intake manifold vacuum conditions, whereas conventional turbochargers and superchargers reduce vehicle mileage during the same conditions. It is expected that the vehicle highway mileage may be increased to the extent of 10% or more as compared to the same vehicle engine equipped with a conventional turbocharger or supercharger. The system is fairly simple, quite small, and highly cost effective. It is expected that the compressor-/expander of the present invention, when operating under supercharger mode, will have higher supercharger compression efficiencies as compared to conventional units, keeping in mind that conventional units also have negative expansion efficiencies in that they rob engine power under engine intake manifold vacuum conditions.

It should be appreciated from the above that in a simplified sense, the present invention is broadly directed to an expansion/compression system for efficient power output regulation of internal combustion engines, whether within a vehicle for driving the same or stationary. The system includes an expansion/compression device which permits the admission of atmospheric pressure air from a predetermined minimum volume to a predetermined maximum volume. Relative to engine intake volume, this could range from 0 to a maximum of 3 or greater. Further, the air admission is to an increasing volume chamber within the device and is externally adjustable from the minimum to maximum predetermined values. The device is required only to have a moving wall or walls to permit expansion and compression. It further requires means for abruptly cutting off air admission, as desired by an engine operator or through an automatic control system; whereby, the device trapped air volume increases to the maximum predetermined value by expansion, under conditions where the trapped volume is less than the maximum predetermined volume, and at this point the device trapped volume is reduced by compression until the engine intake volume level is reached. At this point a fixed discharge port within the device is exposed, and the device air is now expelled into the engine intake manifold as the device volume reduces to 0. As such, the device may be directly or indirectly coupled to the engine under conditions where its maximum volume per engine revolution remains essentially a fixed ratio of engine displacement per engine revolution. Since the device has a fixed compression ratio itself, high admission will result in low expansion and net compression. This produces a very efficient supercharging effect if the initial selection of maximum device volume allows it. With the control means permitting low admission, this results in a very high initial expansion with resulting net expansion upon compression completion, whereby both atmospheric pressure induced flow work and expansion work are recovered by the device and delivered as recovery of waste energy to the engine drive train system.

While the invention has been particularly shown and described with reference to a preferred embodiment thereof, it will be understood by those skilled in the art that various changes in form and details may be made therein without departing from the spirit and scope of the invention.

What is claimed is:

1. An expansion/compression system for efficient power output regulation of an internal combustion engine having a given engine intake displacement, and an engine drive train, an engine intake manifold leading thereto and an engine exhaust manifold leading therefrom, said system comprising:

an engine intake air expansion/compression device coupled to said engine and driven thereby under device compression mode and acting to drive said engine under device expansion mode, said device having a variable volume chamber whose volume varies from a predetermined minimum to a predetermined maximum relative to said engine intake displacement, said device further including engine control means for admitting and abruptly trapping a predetermined volume of atmospheric air within said chamber, means for expanding said trapped volume of air within said chamber to said maximum volume, means for reducing said trapped volume of air within said chamber after expansion until the engine intake displacement volume level is reached, and means for exposing said trapped volume of air to the engine intake manifold only when said engine intake displacement volume level is reached, such that with said device coupled to the engine, its maximum chamber volume per engine revolution remains essentially a fixed ratio of engine intake displacement per engine revolution, and whereby, a high volume of atmospheric pressure air admission to said chamber will result in low expansion and net compression providing an efficient supercharging effect depending upon the ratio of maximum device volume to engine intake volume, while low volume admission of atmospheric air results in high expansion but with resulting net expansion upon compression completion such that both atmospheric pressure induced flow work and expansion work are recovered by the device and delivered to the engine drive train.

2. The expansion/compression system as claimed in claim 1, wherein said device comprises a helical screw rotary compressor/expander including a casing, a pair of laterally intersecting, parallel cylindrical bores within said casing, a pair of intermeshed helical screw rotors mounted for rotation about parallel axes within respective bores with said variable volume chamber defined by said casing and said intermeshed helical screw rotors, said means for admitting and trapping atmospheric pressure air to said device variable volume chamber comprises a variable inlet port, said means for exposing said trapped volume to said engine intake manifold comprises a fixed outlet port within said casing opening to said variable volume chamber, and said variable inlet port comprises a slide valve mounted to said casing constituting said control means and variably closing off and opening the access to said variable volume chamber, and said fixed outlet port opens directly to said engine intake manifold.

3. A compressor/expander for supplying air to an internal combustion engine of an internal combustion engine driven vehicle, said vehicle including an engine drive train, said engine having at least one cylinder housing a reciprocating piston defining the engine intake displacement, an air intake mainfold opening to said cylinder, an exhaust manifold leading from said cylinder, said compressor/expander having an air inlet port open to the atmosphere and a fixed air outlet port, said compressor/expander air outlet port being connected to the engine intake manifold, the improvement residing in said compressor/expander being a positive displacement machine, means for directly connecting said compressor/expander to the engine drive train such that the engine normally drives the compressor/expander when operating under compression mode and the compressor/expander helps drive the engine when operating under expander mode, the volume ratio of the compressor/expander being substantially equal to the displacement of the compressor/expander divided by the intake displacement of the engine, and control means operatively mounted to the compressor/expander at the compressor/expander air inlet port for progressively cutting off the inlet port and varying the volume of air introduced into the compressor/expander at atmospheric pressure to directly vary the output power of the engine;

whereby, when the compressor/expander operates in a supercharging mode, the control means is at a position whereby the compressor/expander increases the air pressure available at the outlet port to always expose the compressed air via the fixed outlet port to the engine intake manifold when the compressed air has reached the pressure level equal to that at which the engine intake is operating, and when operating in an expander mode, the control means operates to always expose the expander recompressed air via the fixed outlet to the engine intake manifold when the expander recompressed air has reached the pressure level equal to that at which the engine intake is operating.

4. The compressor/expander as claimed in claim 3, wherein said compressor/expander is a helical screw rotary positive displacement machine, said machine including a casing, a pair of cylindrical, laterally intersecting parallel axis bores within said casing, a pair of intermeshed, helical screw rotors sized to and mounted respectively within said bores for rotation about their axes, said helical screw rotors being intermeshed and defining with said casing a varying volume expansion/compression chamber, and said control means comprising a slide valve carried by said casing and slidably closing off and opening said air inlet port and said fixed air outlet port is directly connected to said engine intake manifold.

5. The compressor/expander as claimed in claim 4, wherein said volume ratio of the compressor/expander is within the range of 1 to 3.

* * * * *